US010029298B2

(12) United States Patent
Shimizu et al.

(10) Patent No.: US 10,029,298 B2
(45) Date of Patent: Jul. 24, 2018

(54) BAR MATERIAL TRANSFER METHOD AND CONVEYOR

(71) Applicant: NITTAN VALVE CO., LTD., Hadano-shi, Kanagawa (JP)

(72) Inventors: Takahiro Shimizu, Hadano (JP); Shinya Endoh, Hadano (JP); Osamu Takahashi, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 0 days.

(21) Appl. No.: 14/437,098

(22) PCT Filed: Mar. 27, 2013

(86) PCT No.: PCT/JP2013/059092
§ 371 (c)(1),
(2) Date: Apr. 20, 2015

(87) PCT Pub. No.: WO2014/155580
PCT Pub. Date: Oct. 2, 2014

(65) Prior Publication Data

US 2015/0266084 A1 Sep. 24, 2015

(51) Int. Cl.
*B21J 13/10* (2006.01)
*B21K 27/02* (2006.01)
(Continued)

(52) U.S. Cl.
CPC ..... *B21K 27/02* (2013.01); *B21J 13/10* (2013.01); *B21K 1/20* (2013.01); *B21K 1/22* (2013.01)

(58) Field of Classification Search
CPC . H01L 21/67742; B25J 15/00; B25J 15/0019; B25J 15/0028; B25J 15/0491; B21J 13/10; B21K 27/02; B21K 1/22
See application file for complete search history.

(56) References Cited

U.S. PATENT DOCUMENTS 6,346,982 B1 2/2002 Yasuda et al.
8,074,431 B1 * 12/2011 Pierson ..... B65G 47/086 414/791.6
(Continued)

FOREIGN PATENT DOCUMENTS

JP 63-74547 A 4/1988
JP 4-244393 A 9/1992
(Continued)

OTHER PUBLICATIONS

Machine Translation of JP 2002 273539.*
(Continued)

*Primary Examiner* — Jacob Cigna
*Assistant Examiner* — Lee A Holly
(74) *Attorney, Agent, or Firm* — Westerman, Hattori, Daniels & Adrian, LLP

(57) ABSTRACT

A chuck device in a robot hand is used when receiving a primary formed workpiece from electrode chucks. After receiving the primary formed workpiece, and before inserting the primary formed workpiece from its shaft stem part into an insertion hole in a forging press main body, a portion held by the electrode chucks of the primary formed workpiece is gripped by a chuck device different from the chuck device, to release the gripping of the primary formed workpiece by the chuck device. Therefore, it is possible to insert the holding portion held by the electrode chucks from the side of the shaft stem part of the primary formed workpiece into the insertion hole. Thereby providing a bar material transfer method capable of accurately inserting the bar material from its one end into a predetermined positioning hole even if a bar material serving as a workpiece is short.

11 Claims, 11 Drawing Sheets

(51) Int. Cl.
*B21K 1/22* (2006.01)
*B21K 1/20* (2006.01)

(56) References Cited

U.S. PATENT DOCUMENTS

2005/0247166 A1* 11/2005 Sasaki ..... B23P 19/06
81/54
2011/0265311 A1* 11/2011 Kondo ..... B25J 9/0084
29/559

FOREIGN PATENT DOCUMENTS

JP 2002-248542 A 9/2002
JP 2002-273539 A 9/2002
JP 2002273539 A * 9/2002

OTHER PUBLICATIONS

International Search Report dated Jul. 2, 2013, issued in corresponding application No. PCT/JP2013/059092.
Written Opinion of the International Searching Authority dated Jul. 2, 2013, issued in corresponding application No. PCT/JP2013/059092.
Office Action dated Apr. 18, 2017 issued in U.S. Appl. No. 15/349,439.

* cited by examiner

BAR MATERIAL TRANSFER METHOD AND CONVEYOR

TECHNICAL FIELD

The present invention relates to a bar material transfer method and a conveyor.

BACKGROUND ART

On a manufacturing floor, transferring of a workpiece from one device to another device is performed, and for the transfer of a workpiece, a conveyor including gripping means (specifically, a robot hand of a high speed multi-jointed robot) has been widely used. For example, in Patent Document 1 (FIG. 4), a conveyor grips a bar material serving as a workpiece held by holding means of one device with its gripping means, thereby receiving the bar material from the holding means, and conveys the received bar material to a predetermined positioning hole in the other device, and inserts the bar material from its one end part into the predetermined positioning hole, thereby transferring the bar material to the other device. In accordance with this, even if the other end part side of the bar material is processed by the one device, the other device is capable of holding the one end part side of the bar material without exerting an influence on the process.

Meanwhile, in the case where such transfer of a bar material is performed, the other end part side to the utmost extent of the bar material may be gripped as much as possible by the holding means of the one device in order to bring one end part side of the bar material to protrude to the outside from the holding means as much as possible in consideration of handling of a bar material with a short entire length (an entire length in a shaft center extending direction) in some cases. In accordance with this, the gripping means of the conveyor is capable of gripping the one end part side of the bar material, and the bar material can be received from the holding means.

PRIOR ART DOCUMENT

Patent Document

Japanese Published Unexamined Patent Application No. 2002-273539 (FIG. 4)

SUMMARY OF THE INVENTION

Problems to be Solved by the Invention

However, there are bar materials which are fairly short in entire length. In a case where such a bar material is used, even if the holding means holds a bar material, and the gripping means of the conveyor grips one end part side of the bar material, to receive the bar material from the holding means as described above, a protruded length of the bar material (the one end part side of the bar material) from the gripping means of the conveyor to the outside may decrease in some cases. In such a case, an insertion margin of the bar material for a predetermined positioning hole is short, and even if an attempt is made to insert the bar material from its one end part into the predetermined positioning hole in the other device, there is a fear that the insertion is not accurately performed.

The present invention has been made in view of the problem in the above-described conventional art. A first object of the present invention is to provide a bar material transfer method of, even in the case where an entire length of a bar material serving as a workpiece is short, accurately inserting the bar material from its one end part into a predetermined positioning hole.

A second object of the present invention is to provide a conveyor which is used for implementation of the above-described bar material transfer method.

Means for Solving the Problems

In order to achieve the aforementioned first object, in the present invention (the invention according to a first aspect), a bar material transfer method in which a conveyor including gripping means is prepared, the method for gripping a bar material held by holding means on one end part side of the bar material more than a portion held by the holding means with the gripping means of the conveyor, to receive the bar material from the holding means, and conveying the received bar material to a predetermined positioning hole, to insert the bar material from the one end part of the bar material into the predetermined positioning hole, the method includes the processes of using one gripping means in the conveyor at the time of receiving the bar material from the holding means, gripping the portion, which has been held by the holding means, of the bar material with another gripping means which is different from the one gripping means in the conveyor after receiving the bar material, and before inserting the bar material from the one end part of the bar material into the predetermined positioning hole, and releasing the gripping of the bar material by the one gripping means at the time of inserting the bar material from the one end part of the bar material into the predetermined positioning hole. Preferred embodiments according to this first aspect are as described in second to sixth aspects, and a thirteenth aspect.

In order to achieve the aforementioned second object, in the present invention (the invention according to a seventh aspect), a conveyor which includes gripping means having a pair of grippers which is capable of expanding and contracting, the conveyor grips a bar material held by holding means on one end part side of the bar material more than a portion held by the holding means with the pair of grippers of the gripping means, to receive the bar material from the holding means, and conveys the received bar material to a predetermined positioning hole, to insert the bar material from the one end part of the bar material into the predetermined positioning hole, the conveyor in which, first and second gripping means are included so as to be installed adjacent to one another as the gripping means, respective pairs of grippers in the first and second gripping means are disposed so as to be the same in expanding and contracting direction of the respective pairs of grippers, and face one another, the first gripping means is set to grip the bar material on the one end part side of the bar material more than a portion held by the holding means when the pair of grippers of the first gripping means receives the bar material from the holding means, and to release the gripping of the bar material when the bar material is inserted from the one end part of the bar material into the predetermined positioning hole, and the second gripping means is set to grip the portion, which has been held by the holding means, of the bar material after the pair of grippers of the second gripping means receives the bar material, and before the bar material is inserted from the one end part of the bar material into the predetermined positioning hole. Preferred embodiments according to this seventh aspect are as described in eighth to twelfth aspects, and on and after a fourteenth aspect.

Effect of the Invention

In accordance with the present invention (the invention according to the first aspect), the one gripping means in the conveyor is used at the time of receiving the bar material from the holding means, and the portion, which has been held by the holding means, of the bar material is gripped with another gripping means which is different from the one gripping means in the conveyor after receiving the bar material, and before inserting the bar material from the one end part of the bar material into the predetermined positioning hole, and gripping of the bar material by the one gripping means is released at the time of inserting the bar material from the one end part of the bar material into the predetermined positioning hole. Therefore, it is possible to move the bar material by the conveyor including the other gripping means, and on the other hand, it is possible to newly secure the portion, which has been gripped by the one gripping means, of the bar material as an insertion margin (increase an insertion margin) on the one end part side of the bar material, thereby it is possible to accurately insert the one end part side of the bar material into the predetermined positioning hole by inserting the insertion margin into the predetermined positioning hole. For this reason, it is possible to provide a bar material transfer method of, even in the case where an entire length of the bar material serving as a workpiece is short, accurately inserting the bar material from its one end part into a predetermined positioning hole.

In accordance with the invention according to a second aspect, the gripping of the bar material by the other gripping means, and the release of the gripping of the bar material by the one gripping means are performed during conveyance of the bar material. Therefore, the time for gripping of the bar material by the other gripping means, and the time for release of gripping of the bar material by the one gripping means are incorporated into the time for conveyance of the bar material, and there is no need to specially secure the time for gripping of the bar material by the other gripping means, and the time for release of gripping of the bar material by the one gripping means. For this reason, it is possible to rapidly perform transfer of the bar material.

In accordance with the invention according to a third aspect, a hole extending downward is prepared as the predetermined positioning hole, and at the time of inserting the bar material from the one end part of the bar material into the predetermined positioning hole, when the portion, which has been gripped by the one gripping means, of the bar material is inserted into the positioning hole, the gripping of the bar material by the other gripping means is released. Therefore, it is possible to reliably exert a guiding function of the bar material by the predetermined positioning hole by utilizing the portion which has been gripped by the one gripping means as an insertion margin, and thereafter, release of gripping by the other gripping means is performed, thereby it is possible to insert the bar material into the predetermined positioning hole by utilizing its own weight of the bar material and the guiding function by the predetermined positioning hole (inner circumferential surface). For this reason, it is possible to reliably perform insertion of the bar material into the predetermined positioning hole, and it is possible to rapidly perform transfer of the bar material on the basis of early release of gripping by the other gripping means.

In accordance with the invention according to a fourth aspect, a bar-like material for valve formation is used as the bar material, electrodes which grip the bar material, to apply electric current between the electrodes and the bar material ends are used as the holding means, and a holding hole in the forging press main body which holds one end part side of the bar material, to form the other end part of the bar material as a head portion of a valve is used as the predetermined positioning hole. Therefore, even in the case where a primary formed workpiece formed by the upsetter (a bar material whose heated end (the other end part side) is bulge-formed) is short, at the time of transferring the primary formed workpiece from the upsetter to the forging press main body, it is possible to accurately insert the one end part side of the primary formed workpiece into the insertion hole of the forging press main body.

In accordance with the invention according to a fifth aspect, the one gripping means and the other gripping means are provided so as to be installed adjacent to one another as first and second gripping means in one conveyor, and the first gripping means and the second gripping means each include a pair of grippers which is capable of expanding and contracting, and the both pairs of grippers are disposed so as to be the same in expanding and contracting direction of the both pairs of grippers, and face one another. Therefore, it is possible to accurately perform transfer of the bar material by a single conveyor, and it is possible to suppress an increase in equipment and conveyors to the minimum extent possible.

In accordance with the invention according to a sixth aspect, the one gripping means and the other gripping means are separately provided in different conveyors. Therefore, it is possible to concretely and accurately perform transfer of the bar material by use of the two conveyors.

In accordance with the invention according to a seventh aspect, a conveyor including gripping means having a pair of grippers which is capable of expanding and contracting, the conveyor grips a bar material held by holding means on one end part side of the bar material more than a portion held by the holding means with the pair of grippers of the gripping means, to receive the bar material from the holding means, and conveys the received bar material to a predetermined positioning hole, to insert the bar material from the one end part of the bar material into the predetermined positioning hole, the conveyor in which first and second gripping means are included so as to be installed adjacent to one another as the gripping means, respective pairs of grippers in the first and second gripping means are disposed so as to be the same in expanding and contracting direction of the respective pairs of grippers, and face one another, the first gripping means is set to grip the bar material on the one end part side of the bar material more than a portion held by the holding means when the pair of grippers of the first gripping means receives the bar material from the holding means, and to release the gripping of the bar material when the bar material is inserted from the one end part of the bar material into the predetermined positioning hole, and the second gripping means is set to grip the portion, which has been held by the holding means, of the bar material after the pair of grippers of the second gripping means receives the bar material, and before the bar material is inserted from the one end part of the bar material into the predetermined positioning hole. Therefore, by use of the conveyor, it is possible to implement the bar material transfer method according to the first aspect, and it is possible to provide a conveyor which is used for implementation of the bar material transfer method according to the first aspect.

In accordance with the invention according to an eighth aspect, the conveyor includes first and second gripper adjusting means for respectively adjusting expanding and contracting motions of the respective pairs of grippers in the first and second gripping means, receiving timing detection means for detecting a receiving timing of the bar material from the holding means, first gripping detection means for detecting that the first gripping means grips the bar material on the one end part side of the bar material more than the portion held by the holding means, second gripping detection means for detecting that the second gripping means grips the portion, which has been held by the holding means, of the bar material, control means for controlling the first gripper adjusting means to grip the one end part side of the bar material more than the portion which is held by the holding means, of the bar material held by the holding means with the first gripping means in order to start conveying the bar material to the predetermined positioning hole when it is judged as a receiving timing of the bar material from the holding means on the basis of a detection result of the receiving timing detection means, and controlling the second gripper adjusting means to grip the portion, which has been held by the holding means, of the bar material with the second gripping means when it is judged that the first gripping means has gripped the bar material to receive the bar material from the holding means on the basis of a detection result of the first gripping detection means, and further controlling the first gripper adjusting means to release the gripping of the bar material by the first gripping means in order to insert the bar material from the one end part of the bar material into the predetermined positioning hole when it is judged that the second gripping means has gripped the bar material on the basis of a detection result of the second gripping detection means. Therefore, it is possible to provide the specific conveyor in which implementation of the bar material transfer method according to the first aspect is automated.

In accordance with the invention according to a ninth aspect, the conveyor includes positional information detection means for detecting positional information on the first and second gripping means, and the control means is set so as to perform gripping the portion, which has been held by the holding means, of the bar material with the second gripping means, and releasing the gripping of the bar material by the first gripping means between a first predetermined position at which the bar material is spaced at a predetermined distance from the holding means and a second predetermined position before the bar material reaches the predetermined positioning hole on the basis of a detection result of the positional information detection means. Therefore, it is possible to reliably perform switching of gripping the bar material from the first gripping means to the second gripping means without interference with the surrounding devices.

In accordance with the invention according to a tenth aspect, the control means is set so as to stop when it is judged that at least one of gripping the portion, which has been held by the holding means, with the second gripping means, and releasing the gripping of the bar material by the first gripping means is not performed even if the bar material reaches the second predetermined position on the basis of detection results of the first and second gripping detection means and the positional information detection means. Therefore, it is possible to prevent progression to an abnormal state in advance.

In accordance with the invention according to an eleventh aspect, the predetermined positioning hole is set to vertically extend, and the control means is set, when it is judged that the bar material has reached the predetermined positioning hole on the basis of a detection result of the positional information detection means, so as to insert the portion of the bar material which has been held by the first gripping means into the predetermined positioning hole, and stop moving, and to thereafter release the gripping of the bar material by the second gripping means. Therefore, it is possible to provide the conveyor which implements the transfer method according to the third aspect.

In accordance with the invention according to a twelfth aspect, a space between the pair of grippers of the first gripping means and the pair of grippers of the second gripping means is narrowed in a front end side space as compared with a rear end side space between the both pairs of grippers in the direction in which the first and second gripping means are installed adjacent to one another. Therefore, taking gripping of a short bar material by the pair of grippers of the first gripping means and the pair of grippers of the second gripping means into account, it is possible to improve the degree of freedom of attachment of the pair of grippers of the first gripping means and the pair of grippers of the second gripping means with respect to the conveyor.

In accordance with the invention according to a thirteenth aspect, a robot hand or a robot having a robot hand is used as the conveyor. Therefore, it is possible to use an optimum conveyor as the conveyor at the time of accurately inserting the bar material serving as a workpiece which is short in entire length from its one end part into the predetermined positioning hole.

In accordance with the invention according to a fourteenth aspect, the conveyor is composed of a robot hand or a robot having a robot hand. Therefore, it is possible to compose the conveyor by use of an optimum one in order to accurately insert the bar material serving as a workpiece which is short in entire length from its one end part into the predetermined positioning hole.

BEST MODE FOR CARRYING OUT THE INVENTION

Hereinafter, an embodiment of the present invention will be described with reference to the drawings.

Figure 1:
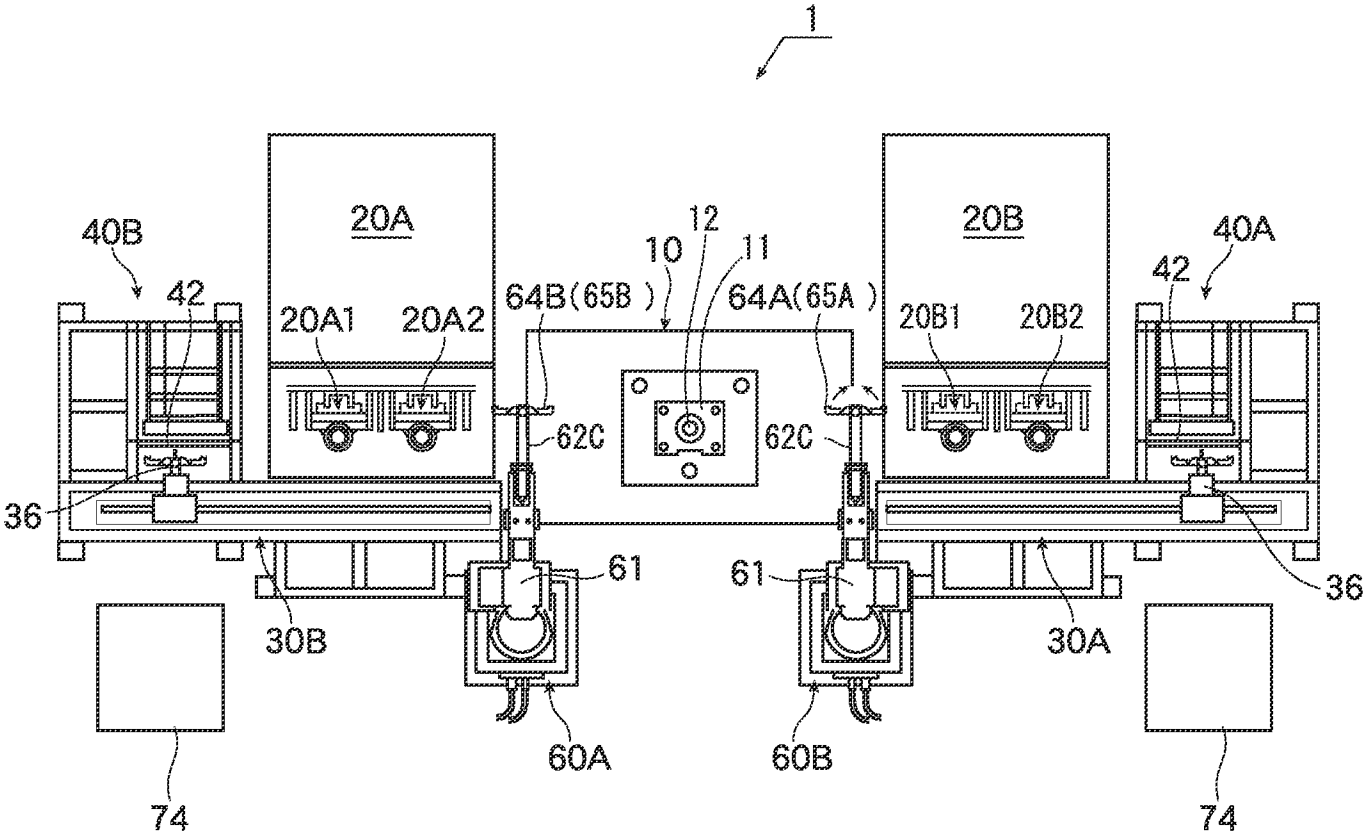
FIG. 1 is a plan view showing an entire configuration of a valve forging automation line according to an embodiment.

FIG. 1 shows a valve forging automation line 1 in which respective devices for forging valves are arranged linearly. In this valve forging automation line 1, a forging press main body 10 is disposed in the center of the linearly-arranged line, and bar material charging devices 40A (40B) and upsetters 20A (20B) are respectively disposed in sequence toward the forging press main body 10 on the both sides of the forging press main body 10. Then, in order to appropriately perform transfer of a workpiece W between the respective devices 10, 20A (20B), and 40A (40B), bar material feeding devices 30A (30B) are respectively disposed on the front face sides of the respective bar material charging devices 40A (40B) and upsetters 20A (20B), and high speed multi-jointed robots (conveyors) 60A (60B) are respectively disposed between the respective upsetters 20A (20B) and the forging press main body 10.

The aforementioned bar material charging device 40A (40B) includes a bar material feeding route 42 as shown in FIG. 1. This bar material feeding route 42 is to feed round bar materials W (bar materials) serving as workpieces sequentially toward the bar material feeding devices 30A (30B) (refer to FIG. 4 as well).

The aforementioned bar material feeding device 30A (30B) includes a chuck 36 for bar material feeding as shown in FIG. 1. This chuck 36 is configured to be slidable in a horizontal direction (the horizontal direction in FIG. 1) and a front-back direction (the vertical direction in FIG. 1) on the front side of the upsetter 20A (20B) and the bar material charging device 40A (40B). This chuck 36 is to grasp the round bar material W on the bar material feeding route 42 in the bar material charging device 40, and feed the round bar material W to vacant forming stages 20A1 and 20A2 (20B1 and 20B2) of the upsetter 20A (20B) (refer to FIG. 4 as well).

Figure 2:
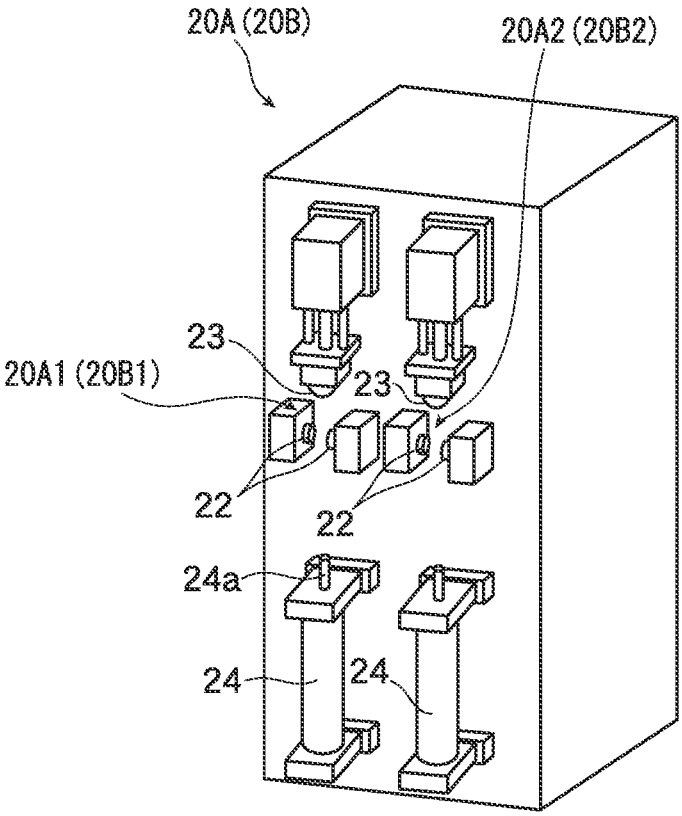
FIG. 2 is a perspective view showing an upsetter used for the valve forging automation line according to the embodiment.
Figure 3:
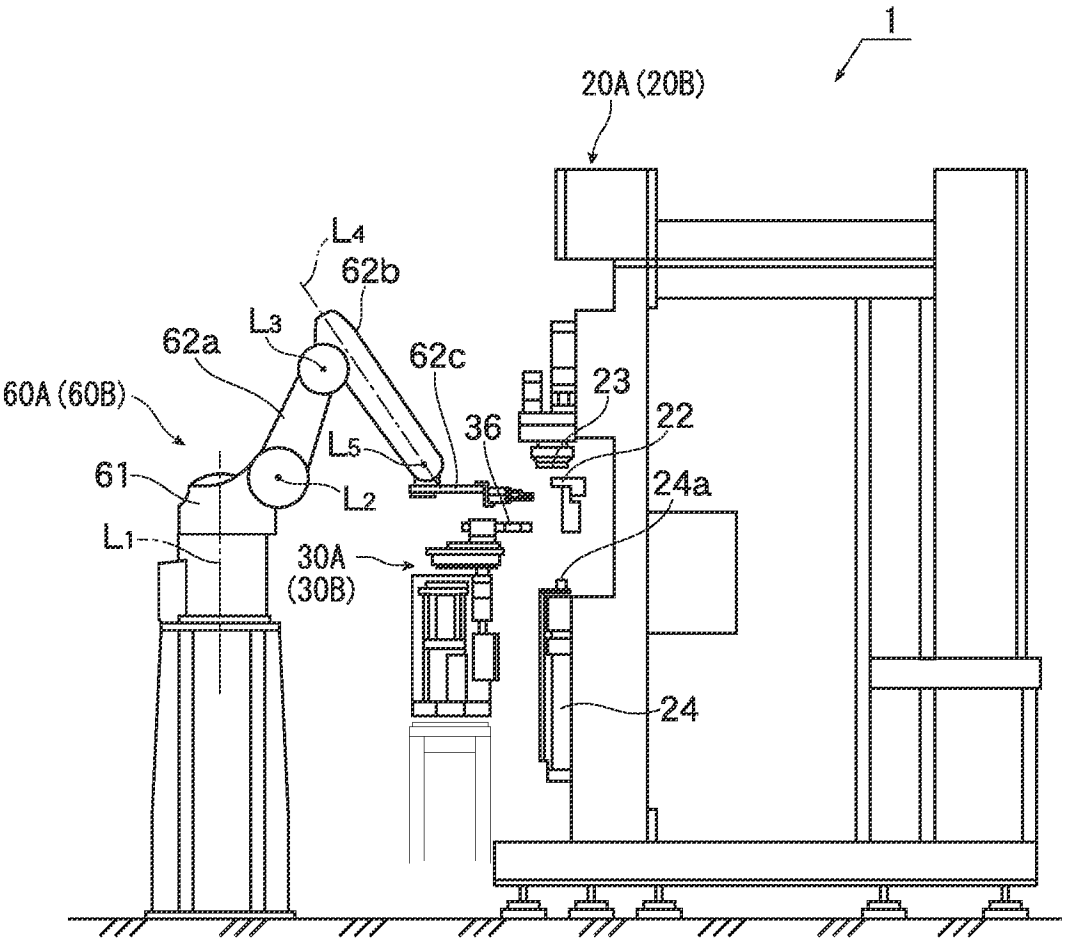
FIG. 3 is a diagram (a diagram viewed from the right side in FIG. 1) showing a high speed multi-jointed robot which conveys a primary formed workpiece to a forging press main body.
Figure 4:
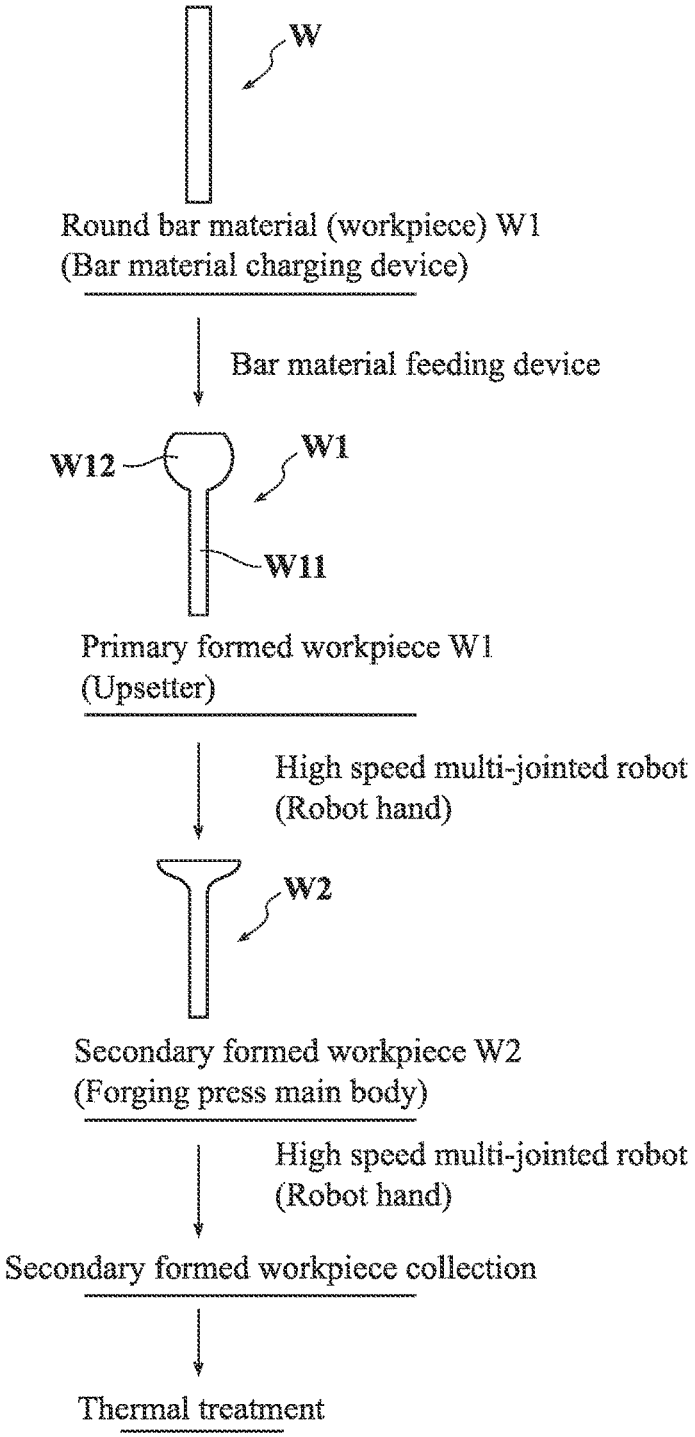
FIG. 4 is an explanatory diagram for explanation of the manufacturing processes of the valve forging automation line according to the embodiment.

The aforementioned upsetter 20A (20B) has a role of forming the round bar material W into a primary formed workpiece W1 (bar material) formed into a shape that one end part side is a stem part W11 and the other end part side is bulging (the bulging portion is denoted by symbol W12) as shown in FIG. 4. Therefore, as shown in FIGS. 1 to 3, the forming stages 20A1 and 20A2 (20B1 and 20B2) are provided so as to be installed adjacent to one another in the horizontal direction on the front face side of the upsetter 20A (20B), and the respective forming stages 20A1 and 20A2 (20B1 and 20B2) are equipped with right and left pairs of electrode chucks 22 and 22 which receive the round bar material W from the chuck 36, to grip the round bar material W so as to vertically extend, anvil electrodes 23 which are disposed above the right and left pairs of electrode chucks 22 and 22, and pressurizing devices 24 which are disposed under the right and left pairs of electrode chucks 22 and 22, to press one end part side of the round bar material W upward, thereby pressing the other end part of the round bar material W against the anvil electrodes 23. In this upsetter 20A (20B), the anvil electrode 23 side of the round bar material W (the other end part side of the round bar material W) is heated to be melted by applying electric current, to be formed into a primary formed workpiece W1 formed into a shape that the heat-melted portion is bulging (having the bulging portion W12), and when the forming is completed, the application of electric current is stopped, to stop heating of the primary formed workpiece W1.

In addition, symbol 24*a* denotes an elevator rod of the pressurizing device 24 which supports the workpiece W from the lower side.

The aforementioned forging press main body 10 has a role of secondarily forming the primary formed workpiece W1 formed in the upsetter 20A (20B) as shown in FIG. 4. Therefore, the forging press main body 10 is equipped with a pair of upper and lower forging dies 11 for secondary formation as shown in FIG. 1. An insertion hole 12 (a predetermined positioning hole) for inserting and holding the stem part of the primary formed workpiece W1 (the portion on the one end part side of the round bar material W) in order to position the bulging portion W12 of the primary formed workpiece W1 on the upper side of the lower mold 11, so as to appropriately perform secondary formation is opened into the top face of the lower mold (hereinafter, the symbol for the forging die 11 is used) in the forging press main body 10 (refer to FIG. 11 which will be described later).

The aforementioned high speed multi-jointed robot 60A (60B) has a role of conveying the primary formed workpiece W1 formed in the upsetter 20A (20B) to the forging press main body 10, to insert the primary formed workpiece W1 into the through hole 12 in the lower mold 11 as shown in FIGS. 1 and 3. Therefore, the high speed multi-jointed robot 60A (60B) is equipped with a robot main body 61, a rear end side arm 62*a*, a front end side arm 62*b*, and a robot hand (conveyor) 62*c*, and the structure which is capable of turning around six axes (L1 to L6) is composed of those respective components 61, and 62*a* to 62*c*. Specifically, the robot main body 61 is capable of circling around a vertical spindle L1, and the rear end side arm 62*a* is capable of turning around a horizontal spindle L2 with respect to the robot main body 61. Further, the front end side arm 62*b* is capable of turning around a horizontal spindle L3 in the front end portion of the rear end side arm 62*a* and a spindle L4 along the central shaft of the arm 62*b* respectively, and the robot hand 62*c* is capable of turning around a horizontal spindle L5 on the front end side of the arm 62*b* and a vertical spindle L6 on the front end side of the arm 62*b*.

As shown in FIGS. 1, 3, 5, and 6, first and second chuck devices 64A and 65A (64B and 65B) are respectively mounted as one gripping means (the first gripping means) and the other gripping means (the second gripping means) to the robot hand 62*c* in the aforementioned high speed multi-jointed robot 60A (60B). The first chuck device 64A (64B) includes a first pair of claw parts (a first pair of grippers) 64A1 (64B1) which expands and contracts (opens and closes) to grip and release gripping the stem part W11 of the primary formed workpiece W1, an air-driven cylinder device (the interior of the cylinder is partitioned into two chambers with a piston, and the piston is displaced by supply adjustment of compressed air to the two chambers, to cause the drive rod to make a telescopic motion due to its displacement motion) 64A2 (64B2) which has a drive rod (not shown), and causes the first pair of claw parts 64A1 (64B1) to expand and contract (open and close) on the basis of a telescopic motion of the drive rod, a compressor 66A (66B) serving as an air-driving source which supplies compressed air to the air-driven cylinder 64A2 (64B2), to cause the drive rod of the air-driven cylinder device 64A2 to make a telescopic motion on the basis of the compressed air, and a first adjusting valve (electromagnetic) 64A3 (64B3) serving as first gripper adjusting means which performs supply adjustment of compressed air from the compressor 66A to the air-driven cylinder device 64A2 (64B2). The second chuck device 65A, which is premised on that the compressor 66A is provided as a common component, includes a second pair of claw parts (a second pair of grippers) 65A1 (65B1), an air-driven cylinder device 65A2 (65B2), and a second adjusting valve (a second pair of grippers) 65A3 (65B3) as components which are the same as those of the first chuck device 64A.

Figure 6:
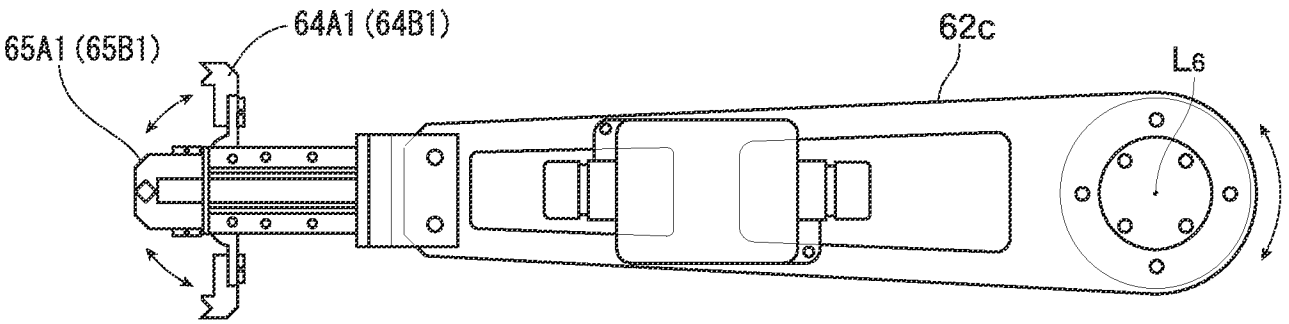
FIG. 6 is an enlarged front view showing around the robot hand of the high speed multi-jointed robot according to the embodiment.

In this case, the first and second pairs of claw parts 64A1 and 65A1 (64B1 and 65B1) in the first and second chuck devices 64A and 65A (64B and 65B) are, as shown in FIG. 6, both capable of opening up to 180 degrees, and close so as to be capable of reliably gripping the stem part W11 of the thin primary formed workpiece W1 serving as a workpiece.

Figure 5:
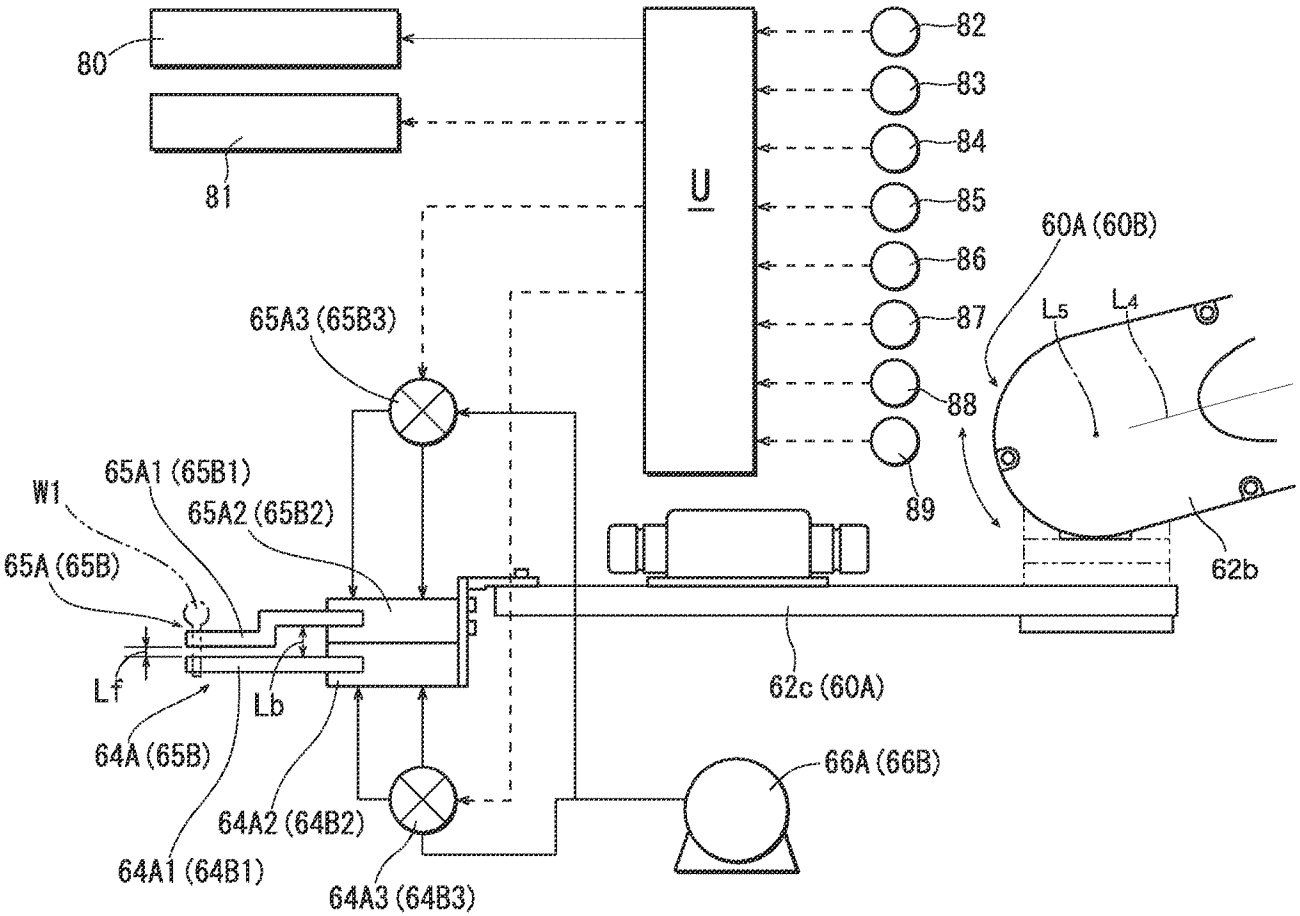
FIG. 5 is an enlarged front view showing around a robot hand of the high speed multi-jointed robot according to the embodiment.

With respect to the first and second pairs of claw parts 64A1 and 65A1 (64B1 and 65B1), in a standard position state (in the state of FIG. 5), the first pair of claw parts 64A1 (64B1) is disposed on the lower side of the second pair of claw parts 65A1 (65B1). The first pair of claw parts 64A1 (64B1) and the second pair of claw parts 65A1 (65B1) are disposed so as to be installed adjacent to one another, and the first and second respective pairs of claw parts 64A1 and 65A1 (64B1 and 65B1) are brought into a layout state so as to be the same in expanding and contracting direction and face one another. In addition, in the present embodiment, a space between the first pair of claw parts 64A1 (64B1) and the second pair of claw parts 65A1 (65B1) is, as shown in FIG. 5, brought into a state in which a front end side space Lf between the both first and second pairs of claw parts 64A1 and 65A1 (64B1 and 65B1) is made as close as possible, so as to respond to gripping of a short round bar material W. On the other hand, a rear end side space Lb is widened as compared with the front end side space Lf in consideration of the facts that the thicknesses of the respective air-driven cylinder devices 64A2 and 65A2 (64B2 and 65B2) must be thicker than the thicknesses of the respective pairs of claw parts 64A1 and 65A1 (64B1 and 65B1), and further, it is intended to improve the degree of freedom of attachment of the respective pairs of claw parts 64A1 and 65A1 (64B1 and 65B1).

Moreover, in the present embodiment, as shown in FIG. 1, a secondary formed workpiece collecting unit 74 is provided on the opposite side of the aforementioned upsetter 20A (20B) over the aforementioned bar material feeding device 30A (30B). This secondary formed workpiece collecting unit 74 has a role of receiving a secondary formed workpiece W2 formed by the forging press main body 10 with the high speed multi-jointed robot 60A (60B) described above, to collect it during a time until the thermal treatment which is the following process is performed.

The high speed multi jointed robot 60A (60B) described above is, as shown in FIG. 5, equipped with a controller unit U (control means) which controls the first adjusting valve 64A3 (64B3), the second adjusting valve 65A3 (65B3), a drive adjusting unit 80 for the electrode chucks 22 and 22, and a robot drive adjusting unit 81. A receiving timing signal from a receiving timing detecting mechanism 82 that detects that heating in the upsetter 20A (20B) is terminated (the completion of formation), an elapsed time $T_{C1}$ signal from a first elapsed time detecting mechanism 83 that detects an elapsed time $T_{C1}$ of a first timer, an elapsed time $T_{C2}$ signal from a second elapsed time detecting mechanism 84 that detects an elapsed time $T_{C2}$ of a second timer, gripping and gripping-release signals from a first claw part state detecting sensor 85 that detects gripping and gripping-released states of the first pair of claw parts 64A1 (64B1), gripping and gripping-release signals from a second claw part state detecting sensor 86 that detects gripping and gripping-released states of the second pair of claw parts 65A1 (65B1), a positional information signal from a positional information detecting sensor 87 that detects positional information on the first and second pairs of claw parts 64A1 and 65A1 (64B1 and 65B1), a moving state signal from a movement detecting sensor 88 that detects the presence or absence of a movement of the robot hand, and holding and holding-release signals from an electrode chuck state detecting sensor 89 that detects holding and holding-released states of the electrode chucks 22 and 22 are input to the controller unit U. On the other hand, control signals are output to the first and second adjusting valves 64A3 and 65A3 (64B3 and 65B3), the drive adjusting unit 80 for the electrode chucks 22 and 22, and the robot drive adjusting unit 81 from the controller unit U.

In this valve forging automation line 1, as shown in FIG. 4, the bar material feeding device 30A (30B) feeds the round bar material W serving as a workpiece fed by the bar material charging device 40A (40B), to the upsetter 20A (20B), and the upsetter 20A (20B) forms the round bar material W into a primary formed workpiece W1 formed into a shape that the other end part side (the upper side in the present embodiment) of the round bar material W is bulging. The primary formed workpiece W1 is conveyed to the forging press main body 10 by the high speed multi-jointed robot 60A (60B), and the primary formed workpiece W1 is formed into a valve as a secondary formed workpiece W2 in the forging press main body 10. This secondary formed workpiece W2 is conveyed to the secondary formed workpiece collecting unit 74 by use of the high speed multi-jointed robot 60A (60B) again, and the secondary formed workpiece W2 collected in the secondary formed workpiece collecting unit 74 is conveyed to a batch-type heating treatment furnace (not shown) by a worker, for example, at the stage at which the secondary formed workpiece W2 is cooled down after a predetermined time elapsed.

In this valve forging automation line 1, at the time of conveying the primary formed workpiece W1 to the forging press main body 10 from the upsetter 20A (20B), a transfer method according to the present embodiment is used. That transfer method will be described on the basis of FIGS. 7 to 12 along with the outline of the aforementioned controller unit U.

Figure 7:
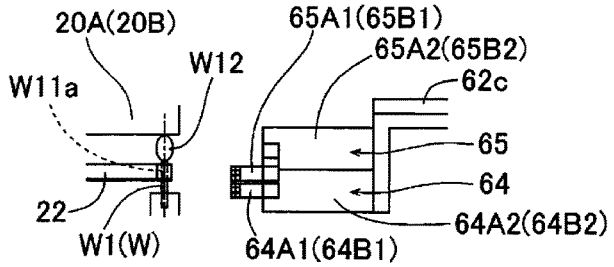
FIG. 7 is an explanatory diagram for explanation of a transfer method according to an embodiment.
Figure 8:
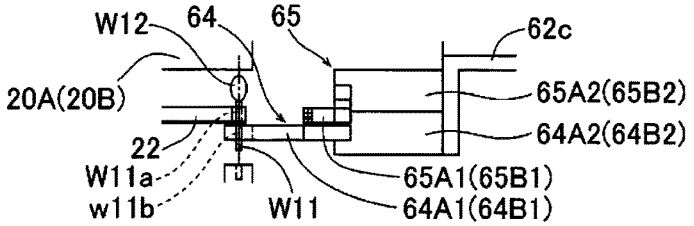
FIG. 8 is an explanatory diagram for explanation following FIG. 7.

In the upsetter 20A (20B), at the time of forming a relatively short round bar material W serving as a workpiece into a primary formed workpiece W1, as shown in FIG. 7, the round bar material W is held so as to be positioned vertically extending by the electrode chucks 22 and 22, and its gripping position is on the other end part side of the round bar material W to the utmost extent (the upper side in FIG. 6). On the other hand, the both first and second pairs of claw parts 64A1 and 65A1 (64B1 and 65B1) of the robot hand 62*c* reach the waiting positions before the completion of formation of the primary formed workpiece W1 in the upsetter 20A (20B), and are waiting in a state in which the respective pairs of claw parts 64A1 and 65A1 (64B1 and 65B1) are open (refer to FIG. 7).

In this presupposed state, when application of electric current (heating) is stopped by considering that the round bar material W serving as a workpiece is formed into the primary formed workpiece W1, and the formation is completed in the upsetter 20A (20B), the first pair of claw parts 64A1 (64B1) grips a stem part lower portion W11*b* on the side lower than the holding portion W11*a* of the stem part W11 of the primary formed workpiece W1 held by the electrode chucks 22 and 22 (the portion on the one end part side of the round bar material W).

Figure 9:
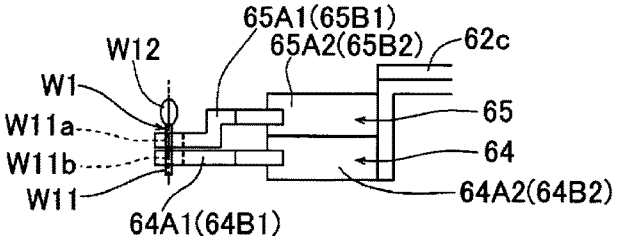
FIG. 9 is an explanatory diagram for explanation following FIG. 8.
Figure 10:
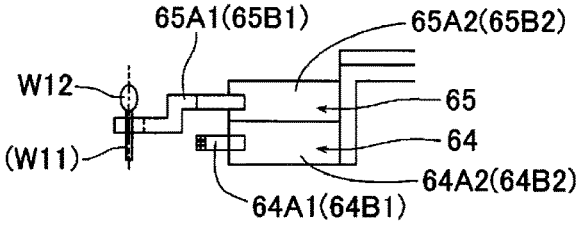
FIG. 10 is an explanatory diagram for explanation following FIG. 9.

As described above, when the first pair of claw parts 64A1 (64B1) grips the stem part lower portion 11*b* of the stem part W11 of the primary formed workpiece W1, the electrode chucks 22 and 22 release the gripping of the primary formed workpiece W1, and according to this, the high speed multi jointed robot 60A (60B) starts to convey the primary formed workpiece W1 toward the forging press main body 10 through the motions of the robot main body 61, the arms 62*a* and 62*b*, and the robot hand 62*c* on the basis of information that the teaching has been undertaken in advance. When this conveyance of the primary formed workpiece W1 is performed, during that conveyance, as shown in FIG. 9, the second pair of claw parts 65A1 (65B1) grips the holding portion W11*a* which has been held until now by the electrode chucks 22 of the stem part W11 of the primary formed workpiece W1, and next, as shown in FIG. 10, the first pair of claw parts 64A1 (64B1) releases the gripping of the stem part lower portion W11*b* of the primary formed workpiece W1. In accordance with this, an insertion margin for the insertion hole 12 in the forging press main body 10 is newly secured with the lower portion W11*b* in the primary formed workpiece W1.

Figure 11:
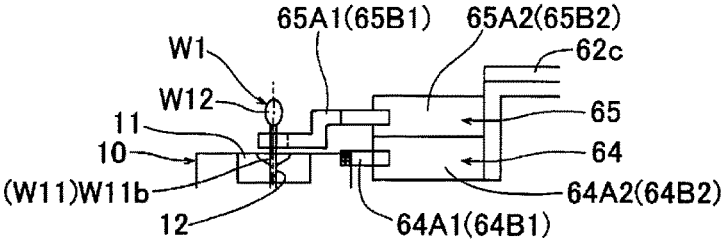
FIG. 11 is an explanatory diagram for explanation following FIG. 10.
Figure 12:
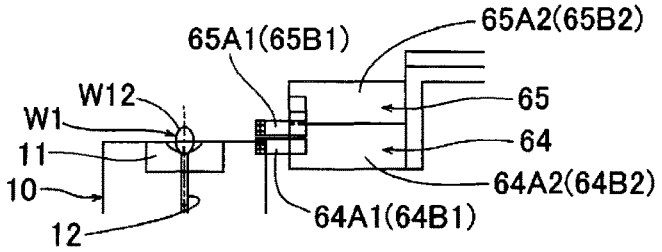
FIG. 12 is an explanatory diagram for explanation following FIG. 11.

When the first pair of claw parts 64A1 (64B1) releases the gripping of the stem part lower portion W11*b* of the primary formed workpiece W1, as shown in FIG. 11, the primary formed workpiece W1 is conveyed to the insertion hole 12 in the forging press main body 10 by gripping by the second pair of claw parts 65A1 (65B1) (the movement of the robot hand 62*c*), and the lower portion W11*b* of the stem part W11 in the primary formed workpiece W1 is inserted into the insertion hole 12 from the upper side. Then, when the stem part lower portion W11*b* in the primary formed workpiece W1 is inserted into the insertion hole 12, the robot hand 62*c* stops moving, and releases the gripping by the second pair of claw parts 65A1 (65B1). In accordance with this, the primary formed workpiece W1 drops down so as to be guided by the inner wall of the insertion hole 12 due to its own weight, and eventually, as shown in FIG. 12, the bulging portion W12 of the primary formed workpiece W1 is received by the lower mold 11, and the primary formed workpiece W1 is accurately set (inserted to be held) in the forging press main body 10 even if its entire length is short.

Figure 13:
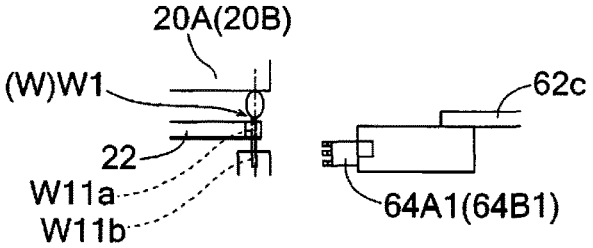
FIG. 13 is an explanatory diagram for explanation of a transfer method according to a conventional technology.
Figure 14:
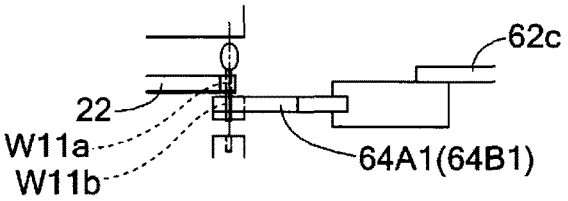
FIG. 14 is an explanatory diagram for explanation following FIG. 13.
Figure 15:
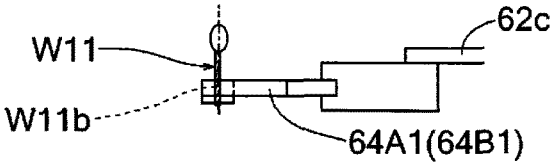
FIG. 15 is an explanatory diagram for explanation following FIG. 14.
Figure 16:
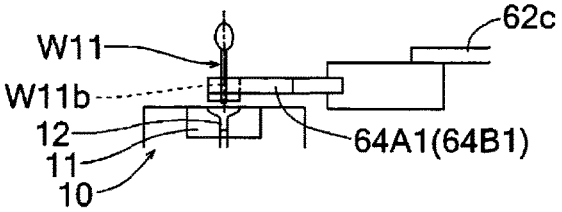
FIG. 16 is an explanatory diagram for explanation following FIG. 15.
Figure 17:
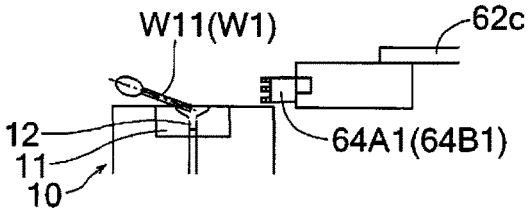
FIG. 17 is an explanatory diagram for explanation following FIG. 16.

On the other hand, in an existing single hand type composed of only the first pair of claw parts 64A1 (64B1), in the case where the round bar material W serving as a workpiece is short, after the round bar material W is formed into the primary formed workpiece W1 by the upsetter 20A (20B), the single hand type grips the stem part lower portion W11*b* on the side lower than the holding portion W11*a* held by the electrode chucks 22, of the primary formed workpiece W1 with the pair of claw parts 64A1 (64B1), thereby it is possible to convey the primary formed workpiece W1 (refer to FIGS. 13 to 15). However, because there is no insertion margin in the stem part W11 of the primary formed workpiece W1 because of that gripping, as shown in FIGS. 16 and 17, even if it is intended to insert the stem part W11 of the primary formed workpiece W1 into the insertion hole 12 in the forging press main body 10, it is impossible to insert the stem part W11 of the primary formed workpiece W1.

Figure 18:
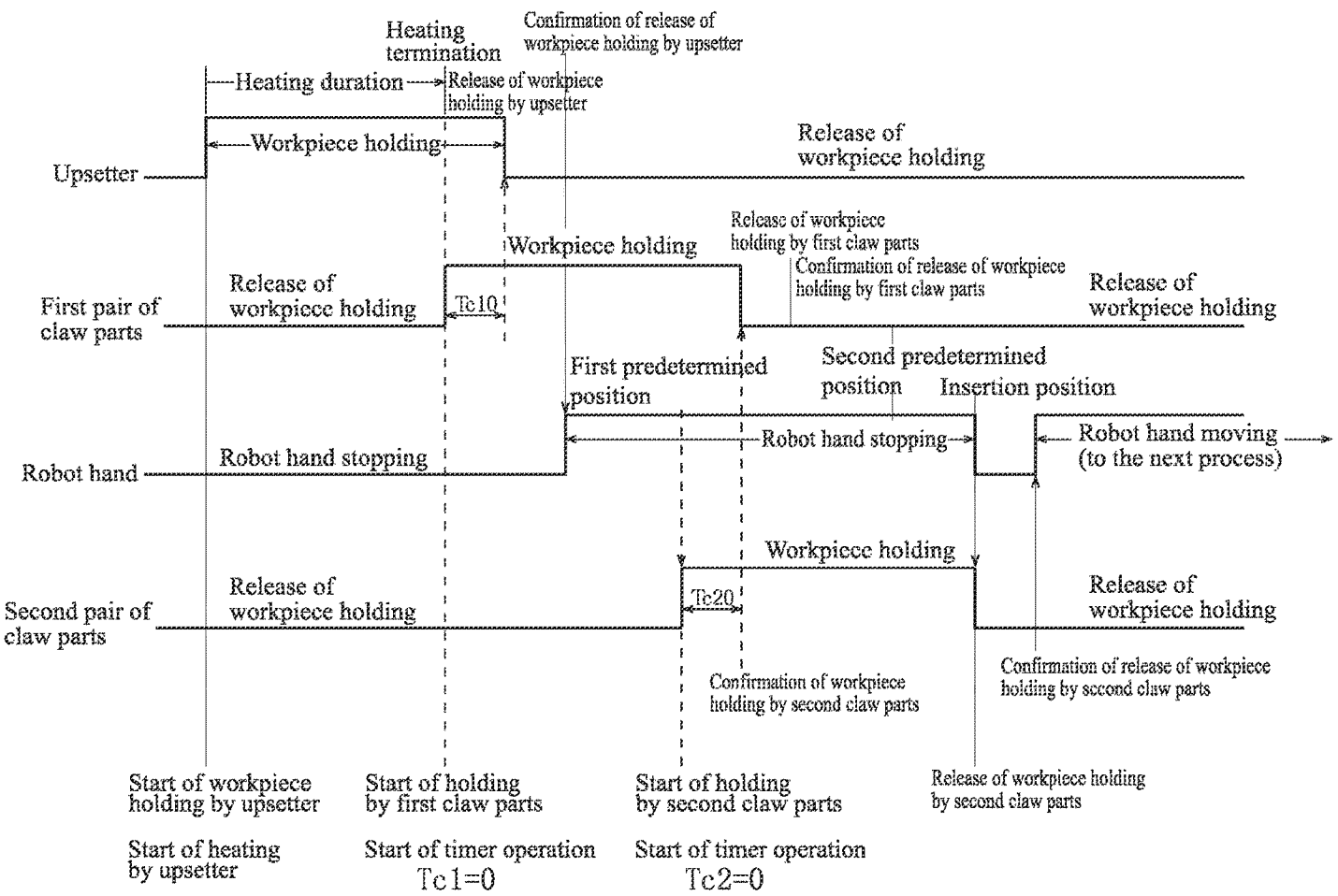
FIG. 18 is a time chart used for the transfer method according to the embodiment.
Figure 19:
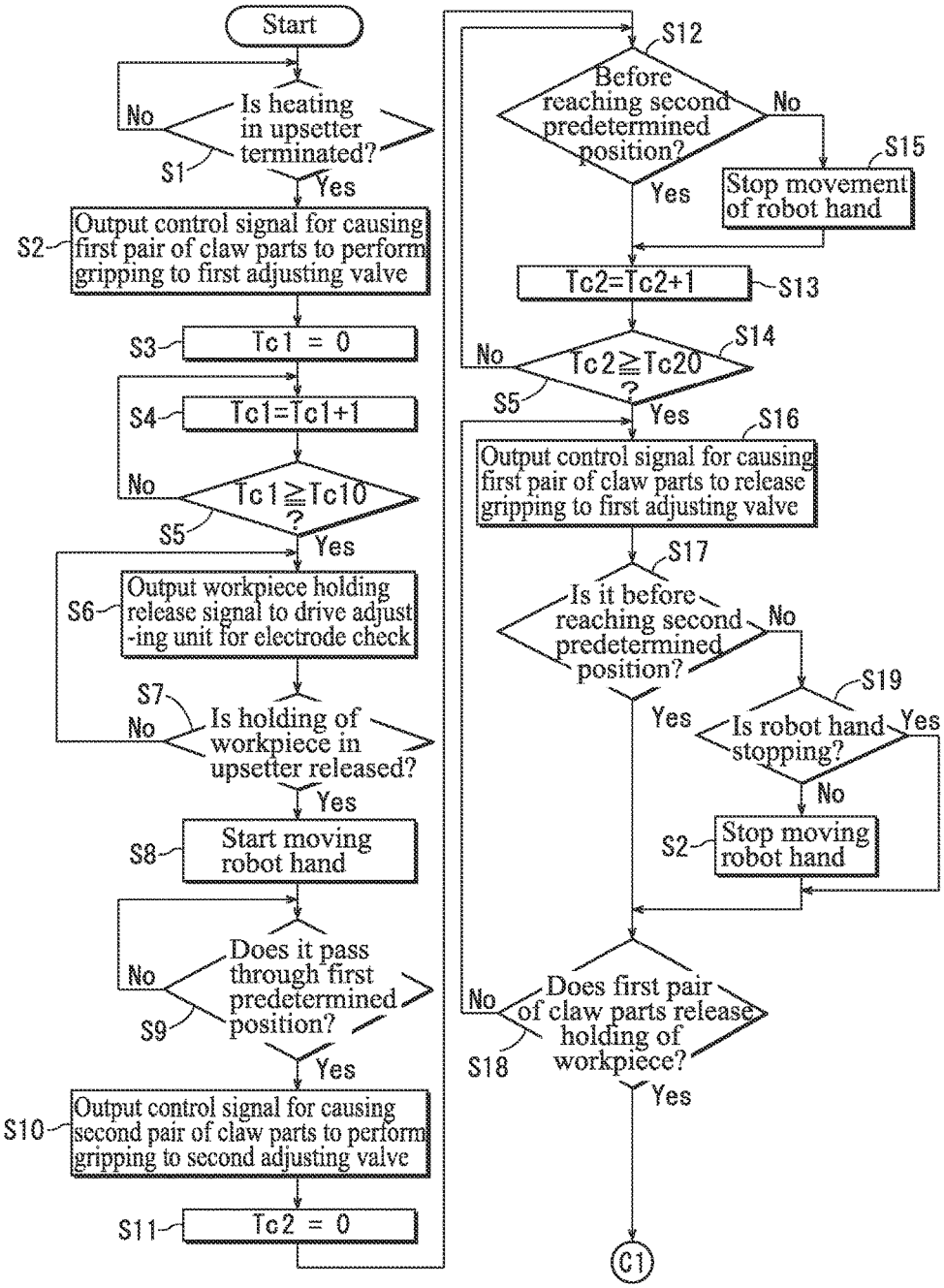
FIG. 19 is a flowchart showing an example of control by a controller unit according to the embodiment.
Figure 20:
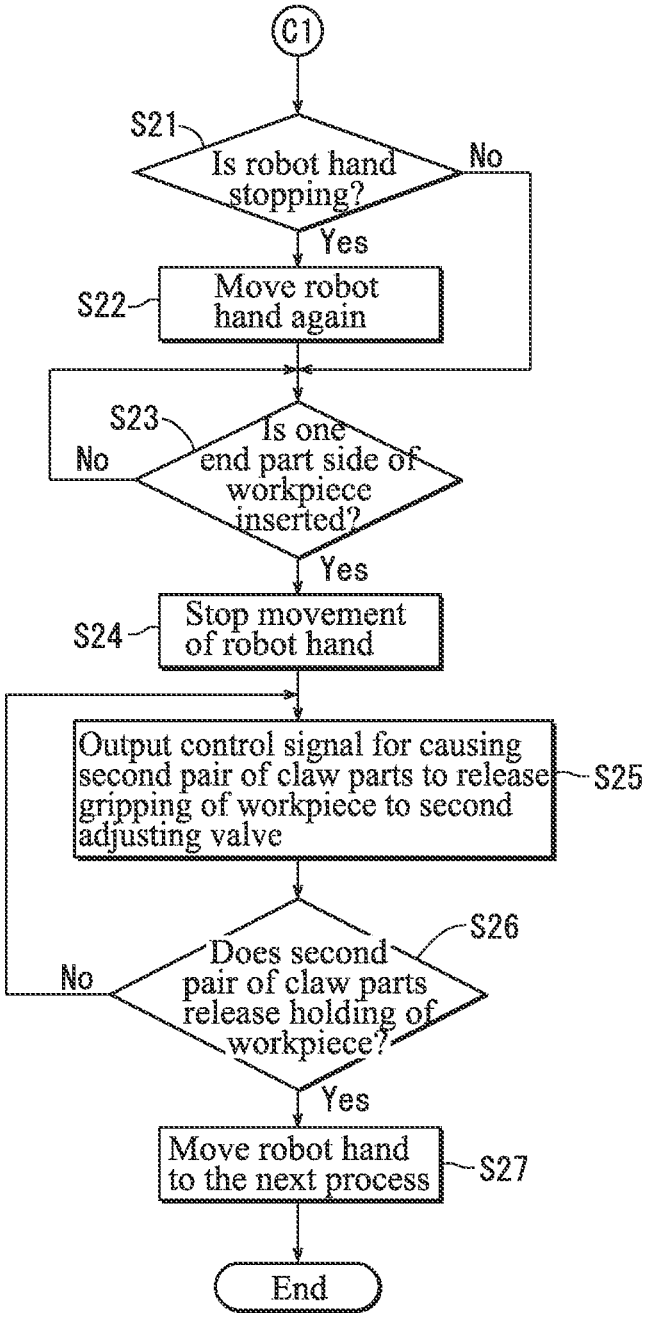
FIG. 20 is a flowchart following FIG. 19.

An example of control by the controller unit U at the time of transferring a workpiece from the upsetter 20A (20B) to the forging press main body 10 will be described in detail on the basis of a time chart shown in FIG. 18, and flowcharts shown in FIGS. 19 and 20. In addition, in FIGS. 19 and 20, S denotes a step. Further, a presupposed state for the start at the time of transferring a workpiece from the upsetter 20A (20B) to the forging press main body 10 is the same as described above (refer to FIG. 6).

First, in S1, it is judged whether or not the heating in the upsetter 20A (20B) is terminated because of the completion of primary formation of the round bar material W. As long as the heating in the upsetter 20A (20B) is not terminated, the judgment is repeated. On the other hand, when it is YES in S1, in S2, a control signal for causing the first pair of claw parts 64A1 (64B1) to perform gripping is output to the first adjusting valve 64A3 (64B3). In accordance with this, the first pair of claw parts 64A1 (64B1) grips the stem part lower portion W11*b* (one end part side portion of the round bar material W) on the side lower than the stem part holding portion W11*a* of the primary formed workpiece W1 (bar material) which is held by the electrode chucks 22 and 22 in the upsetter 20A (20B) (refer to FIG. 8).

Next, in S3, the first timer is set (time TC1=0), and in the following S4, 1 is added to the time TC1, to start counting the time TC1. Then, in the following S5, it is judged whether or not the time TC1 has reached a predetermined time TC10, and when it is judged as NO, the process is returned to S4, to continue counting the time. On the other hand, when it is judged as YES in S5, it is considered that the time TC1 has reached the predetermined time TC10, and in S6, a holding release signal is output to the drive adjusting unit 80 for the electrode chucks 22. In accordance with this, the electrode chucks 22 and 22 release the holding of the primary formed workpiece W1. At this time, because the first pair of claw parts 64A1 (64B1) has already gripped the round bar material W as described above, even if the electrode chucks 22 release the holding of the primary formed workpiece W1, the primary formed workpiece W1 does not drop in any case.

When a holding release signal is output to the drive adjusting unit 80 for the electrode chucks 22 and 22, in S7, it is judged whether or not the electrode chucks 22 and 22 have actually released the holding of the primary formed workpiece W1. When it is judged as No in S7, the process is returned to S6, the processing in S6 and the judgment in S7 are repeated. On the other hand, when it is judged as YES in S7, in S8, driving of the robot main body 61, the arms 62*a* and 62*b*, and the robot hand 62*c* of the high speed multi-jointed robot 60A (60B) is started, and the high speed multi-jointed robot 60A (60B) performs a recorded moving operation that the teaching has been undertaken for the high speed multi-jointed robot 60A (60B). In accordance with this, a movement such as transfer of the primary formed workpiece W1 (a movement of the robot hand 62*c*) is started. In this case, the movement of the primary formed workpiece W1 is performed on the basis of the moving operation of the robot hand 62*c* which holds the primary formed workpiece W1. Meanwhile, the moving operation of the robot hand 62*c* includes not only the moving operation of the robot hand 62*c* itself, but also the moving operation of the robot hand 62*c* on the basis of motions of the robot main body 61 and the arms.

When a movement of the robot hand 62*c* is started to start moving the primary formed workpiece W1, in S9, it is judged whether or not the robot hand 62*c* (the first and second pairs of claw parts 64A1 and 65A1 (64B1 and 65B1) passes through a first predetermined position on the recorded moving operation route. This first predetermined position is spaced at a predetermined distance from the upsetter 20A (20B), and is set as the limit of a position at which, even if the first and second pairs of claw parts 64A1 and 65A1 (64B1 and 65B1) make opening and closing motions, those do not interfere with the upsetter 20A (20B) and the other devices. When it is judged as NO in S9, the judgment is repeated. On the other hand, when it is judged as YES in S9, in S10, a control signal for causing the second pair of claw parts 65A1 (65B1) to perform gripping is output to the second adjusting valve 65A3 (65B3). In accordance with this, the second pair of claw parts 65A1 (65B1) grips the holding portion W11*a* which has been held until now by the electrode chucks 22 and 22 in the upsetter 20A (20B), of the stem part W11 of the primary formed workpiece W1 (refer to FIG. 9).

When the control signal for causing the second pair of claw parts 65A1 (65B1) to perform gripping is output to the second adjusting valve 65A3 (65B3) in S10, the second timer is set (time TC2=0) in S11, and in S12, it is judged whether or not the robot hand 62*c* (the first and second pairs of claw parts 64A1 and 65A1 (64B1 and 65B1)) has not yet reached a second predetermined position on the recorded moving operation route. This second predetermined position is spaced at a predetermined distance from the forging press main body 10, and is set as the limit of a position at which, even if the first and second pairs of claw parts 64A1 and 65A1 (64B1 and 65B1) make opening and closing motions, those (including the primary formed workpiece W1 as well) do not interfere with the forging press main body 10 and the other devices. When it is judged as YES in S12, it is considered that an interference problem is not caused with respect to the first and second pairs of claw parts 64A1 and 65A1 (64B1 and 65B1), after the time TC2 is counted in the state in which the robot hand 62*c* moves (S13), the process proceeds to the following S14. On the other hand, when it is judged as NO in S12, that is, when it is judged that the robot hand 62*c* has reached the second predetermined position, it is considered that an interference problem is caused with respect to the first and second pairs of claw parts 65A1 and the like due to the following movement, and in S15, the movement of the robot hand 62*c* (the robot main body 61, the arms 62*a* and 62*b*) is stopped, and in S13, the time TC2 is counted in the state in which the robot hand 62*c* is stopped.

In the following S14, it is judged whether or not the time $T_{C2}$ has reached a predetermined time $T_{C20}$. When it is judged as NO in S14, the process is returned to S12, and a series of processings (S12 to S14, and S15) is repeated. On the other hand, when it is judged as YES in S14, in S16, a control signal for causing the first pair of claw parts 64A1 (64B1) to release the gripping is output to the first adjusting valve 64A3 (64B3). In accordance with this, the first pair of claw parts 64A1 (64B1) releases the gripping of the primary formed workpiece W1. At this time, because the second pair of claw parts 65A1 (65B1) is gripping the stem part W11 of the primary formed workpiece W1, the primary formed workpiece W1 does not drop in any case, and further, because of the release of the gripping by the first pair of claw parts 64A1 (64B1), the stem part lower portion W11*b* of the primary formed workpiece W1 is released, so as to secure an insertion margin.

In S16, when the control signal for causing the first pair of claw parts 64A1 (64B1) to release the gripping is output to the first adjusting valve 64A3 (64B3), in S17, it is judged whether or not the robot hand 62*c* (the first and second pairs of claw parts 64A1 and 65A1, and the primary formed work W1) has not yet reached the second predetermined position. When it is judged as YES in S17, it is considered that an interference problem is not caused with respect to the first and second pairs of claw parts 64A1 and 65A1, etc., and in the state in which the robot hand 62*c* moves, in the following S18, it is judged whether or not the first pair of claw parts 64A1 (64B1) has released the gripping. On the other hand, when it is judged as NO in S17, in S19, it is judged whether or not the movement of the robot hand 62*c* is stopped. When the robot hand 62*c* has not yet been stopped, in S20, the process proceeds to S18 after the movement of the robot hand 62*c* is stopped, and in the case where it is judged by the judgment in S19 that the robot hand 62*c* has been already stopped, the process directly proceeds to S17.

In S18, when it is judged that the first pair of claw parts 64A1 (64B1) has not released the gripping, the process is returned to S16, and a series of processings (S16 to S20) is repeated. On the other hand, when it is judged as YES in S18, it is judged that the first pair of claw parts 64A1 (64B1) has released the gripping, and in S21, it is judged whether or not the robot hand 62*c* has been stopped. When it is judged as YES in S21, because the robot hand 62*c* has been stopped, in S22, the robot hand 62*c* again starts moving. In the following S23, it is judged whether or not the stem part W11 of the primary formed workpiece W1 is inserted from the upper side into the insertion hole 12 of the lower mold 11 in the forging press main body 10 on the basis of the movement of the robot hand 62*c*. On the other hand, when it is judged as NO in S21, the process directly proceeds to S23.

In S23, when it is judged as NO, its judgment processing is repeated. On the other hand, when it is judged as YES in S23, in S24, the movement of the robot hand 62*c* is stopped, and in the following S25, a control signal for causing the second pair of claw parts 65A1 (65B1) to release the gripping is output to the second adjusting valve 65A3 (65B3), and the second pair of claw parts 65A1 (65B1) releases the gripping of the primary formed workpiece W1. In accordance with this, the primary formed workpiece W1 drops due to its own weight, and the stem part W11 of the primary formed workpiece W1 is inserted into the insertion hole 12 so as to be guided by the inner wall of the insertion hole 12 in the forging press main body 10.

In the following S26, it is judged whether the second pair of claw parts 65A1 (65B1) has actually released the gripping. When it is judged as NO in S26, the process is returned to S25, to wait for that the second pair of claw parts 65A1 (65B1) releases the gripping. On the other hand, when it is judged as YES in S26, in S27, it is considered that the transfer of the primary formed workpiece W1 to the forging press main body 10 is terminated, and the robot hand 62*c* proceeds to the following process.

The embodiment has been described above. Meanwhile, the present invention includes the following modes.

(I) The present invention is used for, not only transfer in valve forging, but also other uses.

(II) The both first and second pairs of claw parts 64A1 and 65A1 (64B1 and 65B1) are not provided for one robot hand, and a pair of claw parts is provided for each of two robots, and transfer of a primary formed workpiece serving as a workpiece (conveyance from the upsetter 20A (20B) to the forging press main body 10) is performed by use of the two robots.

REFERENCE SIGNS LIST

10 . . . Forging press main body
11 . . . Forging die for forging press main body
12 . . . Insertion hole (Predetermined positioning hole, holding hole)
20A, 20B . . . Upsetter
22 . . . Electrode chuck (Holding means)
60A, 60B . . . High speed multi jointed robot (conveyor)
62*c* . . . Robot hand (conveyor)
64A, 64B . . . Chuck devices (One and another gripping means, First and second gripping means)
64A1, 64B1 . . . First pair of claw parts (A pair of grippers of the first gripping means)
65A1, 65B1 . . . Second pair of claw parts (A pair of grippers of the second gripping means)
64A3, 64B3 . . . First adjusting valve (First gripper adjusting means)
65A3, 65B3 . . . Second adjusting valve (Second gripper adjusting means)
81 . . . Robot drive adjusting unit
82 . . . Receiving timing detecting mechanism (Receiving timing detection means)
83 . . . First elapsed time detecting mechanism
84 . . . Second elapsed time detecting mechanism
85 . . . First claw part state detecting sensor (First gripping detection means)
86 . . . Second claw part state detecting sensor (Second gripping detection means)
87 . . . Positional information detecting sensor (Positional information detection means)
88 . . . Movement detecting sensor
Lf . . . Front end side space between the first pair of claw parts and the second pair of claw parts
Lb . . . Rear end side space between the first pair of claw parts and the second pair of claw parts
W . . . Round bar material (Bar material)
W1 . . . Primary formed workpiece (Bar material)
W11 . . . Stem part of primary formed workpiece
W11*a* . . . Holding portion held by electrode chucks of the stem part of the primary formed workpiece
W11*b* . . . Stem part lower portion of the primary formed workpiece
W2 . . . Secondary formed workpiece (Bar material)
U . . . Controller unit (Control means)

The invention claimed is:

1. A bar material transfer method, comprising:

providing a conveyor having a first pair of grippers and a second pair of grippers, the first pair of grippers and the second pair of grippers both being moved by the conveyor in accordance with conveyance movement of the conveyor;

the first pair of grippers receiving an elongated bar material from a holder by gripping a part that is closer to a positioning hole insertion end of the bar material with respect to a distal portion that is held by the holder of the bar material;

the second pair of grippers gripping the same distal portion held by the holder of the bar material after the first pair of grippers receiving the bar material and after the holder releasing the distal portion of the bar material held by the holder;

the conveyor conveying the received bar material to a predetermined positioning hole and inserting the bar material into the predetermined positioning hole by inserting the positioning hole insertion end of the bar material lengthwise into the predetermined positioning hole, wherein the first pair of grippers releases the bar material after starting of the conveyor conveying the received bar material to the predetermined positioning hole but before the inserting of the bar material into the predetermined positioning hole such as to expose the part that is closer to the positioning hole insertion end to increase an insertion margin of the elongated bar material for improved insertion into the predetermined insertion hole.

2. The bar material transfer method according to claim 1, wherein the gripping of the bar material by the second pair of grippers, and the releasing of the gripping of the bar material by the first pair of grippers are performed during conveyance of the bar material by the conveyor.

3. The bar material transfer method according to claim 2, wherein a hole extending downward is prepared as the predetermined positioning hole, and during inserting of the positioning hole insertion end of the bar material into the predetermined positioning hole, when the part that is closer to the positioning hole insertion end, which was gripped by the first pair of grippers, of the bar material is inserted into the predetermined positioning hole, the gripping of the bar material by the second pair of grippers is released.

4. The bar material transfer method according to claim 3, wherein a pair of electrodes which grip the bar material, to apply electric current between the electrodes and the bar material ends are used as the holder, and a holding hole in the forging press main body which holds the insertion margin of the bar material, to form a head portion of a valve, is used as the predetermined positioning hole.

5. The bar material transfer method according to any one of claims 1 to 4, wherein the first pair of grippers and the second pair of grippers are installed adjacent to each other in the conveyor, and the first pair of grippers and the second pair of grippers each includes a pair of gripper claws which are capable of expanding and contracting, and the both pairs of gripper claws are disposed so as to be the same in expanding and contracting direction of the both pairs of gripper claws, and face one another.

6. A bar material transfer method, comprising:

providing a first conveyor and a second conveyor, the first conveyor having a first pair of grippers and the second conveyor having a second pair of grippers, the first pair of grippers being moved by the first conveyor in accordance with conveyance movement of the first conveyor, the second pair of grippers being moved by the second conveyor in accordance with conveyance movement of the second conveyor;

the first gripper receiving a bar material from a holder by gripping a part closer to one end part with respect to a portion held by the holder of the bar material and the holder releasing the portion held by the holder, of the bar material;

after the holder releasing the bar material, the first conveyor conveying the received bar material toward a predetermined positioning hole to insert the bar material into the predetermined positioning hole form the one end part of the bar material, the second gripper gripping the portion held by the holder of the bar material and being moved by the second conveyor in accordance with conveyance movement of the first conveyor; and the first gripper releasing the bar material before the inserting of the bar material into the predetermined positioning hole.

7. The bar material transfer method according to any one of claims 1 to 4, wherein a robot hand or a robot having a robot hand is used as the conveyor.

8. The bar material transfer method according to claim 6, wherein the gripping of the bar material by the second pair of grippers, and the releasing of the gripping of the bar material by the first pair of grippers are performed during conveyance of the bar material by the conveyor.

9. The bar material transfer method according to claim 8, wherein a hole extending downward is prepared as the predetermined positioning hole, and at the time of inserting the bar material from the one end part of the bar material into the predetermined positioning hole, when the part, which has been gripped by the first pair of grippers, of the bar material is inserted into the predetermined positioning hole, the gripping of the bar material by the second pair of grippers is released.

10. The bar material transfer method according to claim 9, wherein a pair of electrodes which grip the bar material, to apply electric current between the electrodes and the bar material ends are used as the holder, and a holding hole in the forging press main body which holds one end part side of the bar material, to form the other end part of the bar material as a head portion of a valve, is used as the predetermined positioning hole.

11. The bar material transfer method according to any one of claims 6, 8, 9, and 10, wherein a robot hand or a robot having a robot hand is used as the first and second conveyor.

* * * * *